US008336459B1

(12) United States Patent
Gould

(10) Patent No.: US 8,336,459 B1
(45) Date of Patent: Dec. 25, 2012

(54) FLARE ADAPTER AND CONVERSION KIT FOR SHOTGUN

(75) Inventor: Jeffrey Hayes Gould, Bangor, PA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 284 days.

(21) Appl. No.: 12/851,745

(22) Filed: Aug. 6, 2010

(51) Int. Cl.
*F42B 4/26* (2006.01)
*F41C 27/06* (2006.01)

(52) U.S. Cl. ..... 102/336; 42/1.15

(58) Field of Classification Search ..... 102/336, 102/335, 346, 341, 342, 446, 502, 513; 42/1.15, 42/90

See application file for complete search history.

(56) References Cited

U.S. PATENT DOCUMENTS

| | | | | | |
|---|---|---|---|---|---|
| 1,947,834 | A | * | 2/1934 | Driggs, Jr. et al. | 102/340 |
| 2,789,501 | A | * | 4/1957 | Sawicki | 102/341 |
| 3,044,360 | A | * | 7/1962 | Stefan et al. | 89/1.1 |
| 3,062,144 | A | * | 11/1962 | Kenneth Hori Katsu et al. | 102/430 |
| 3,202,099 | A | * | 8/1965 | Wortley, Jr. et al. | 102/342 |
| 3,315,397 | A | * | 4/1967 | Gilliam et al. | 42/1.15 |
| 3,654,867 | A | * | 4/1972 | Murray | 102/334 |
| 3,708,902 | A | * | 1/1973 | Foster et al. | 42/106 |
| 3,717,068 | A | * | 2/1973 | Cochran et al. | 89/1.806 |
| 4,266,357 | A | * | 5/1981 | Greenleaf | 42/1.15 |
| 5,148,620 | A | * | 9/1992 | Nelson | 42/77 |
| 5,157,210 | A | * | 10/1992 | Davis | 42/77 |
| 5,198,600 | A | * | 3/1993 | E'Nama | 42/90 |
| 6,128,845 | A | * | 10/2000 | Jacobson | 42/1.15 |
| 6,295,751 | B1 | * | 10/2001 | Piwonski | 42/1.15 |
| 7,866,265 | B1 | * | 1/2011 | Kravel et al. | 102/336 |
| 2004/0088897 | A1 | * | 5/2004 | Braverman | 42/1.09 |
| 2009/0133310 | A1 | * | 5/2009 | Wossner et al. | 42/77 |

* cited by examiner

*Primary Examiner* — Michael Carone
*Assistant Examiner* — Joshua Freeman
(74) *Attorney, Agent, or Firm* — Michael C. Sachs

(57) ABSTRACT

A pen flare may be adapted for firing from a weapon having a caliber larger than a caliber of the pen flare. The adapted flare may be fired from a conventional shotgun. The adapted flare may include a pen flare with a portion having external threads and a base. The base may include an extractor rim and a through-bore with internal threads. The pen flare may be fixed in the through-bore of the base via the external and internal threads. A rear portion of the base may have an outer diameter that is greater than an outer diameter of a front portion of the base. A cylindrical sleeve may be disposed around the front portion of the base and around the pen flare. A conventional shotgun may be reversibly converted to a compact, lighter weight shotgun with a kit. The converted shotgun may be more desirable for firing flares.

13 Claims, 7 Drawing Sheets

FLARE ADAPTER AND CONVERSION KIT FOR SHOTGUN

STATEMENT OF GOVERNMENT INTEREST

The inventions described herein may be manufactured, used and licensed by or for the U.S. Government for U.S. Government purposes.

BACKGROUND OF THE INVENTION

The invention relates in general to signaling devices and, in particular, to flares.

Since early in Operation Enduring Freedom (OEF) and Operation Iraqi Freedom (OIF) there has been a need for non-lethal warnings to be used as part of escalation of force (EOF). Individuals and/or vehicles may approach a foot patrol, vehicle convoy, or a checkpoint (CP) in a potentially hostile manner. A traditional solution has been to fire non-lethal flares at the individuals or the vehicles. The non-lethal flares may assist in determining the intent of an individual or motorist before deadly force is employed.

The flare launchers currently in use may be single shot and may not have a safety mechanism. The known flare launchers may be slow to reload, particularly if multiple shots are needed. Existing flare launchers may accidentally discharge if dropped. Accidental discharge is a concern for soldiers who desire to carry a loaded launcher. A need exists for an apparatus and method for firing multiple non-lethal warnings to potentially hostile approaching individuals and/or vehicles.

SUMMARY OF THE INVENTION

It is an object of the invention to provide an apparatus and method for firing multiple non-lethal warnings to potentially hostile approaching individuals and/or vehicles.

One aspect of the invention may be a method. The method may include adapting a pen flare for firing from a weapon having a caliber larger than the caliber of the pen flare. The pen flare may include external threads. Adapting the pen flare may include providing a base having a through-bore with internal threads, and threading the pen flare into the base.

Another aspect of the invention may be a kit for adapting a pen flare with external threads for firing from a weapon of a certain caliber. The kit may include a base and a cylindrical sleeve. The base may have an extractor rim and a through-bore with internal threads for mating with the external threads of the pen flare. A rear portion of the base, located forward of the extractor rim, may have an outer diameter that is greater than an outer diameter of a front portion of the base. The cylindrical sleeve may be disposed around the front portion of the base and around the pen flare.

In another aspect, the invention may include a flare for firing from a weapon of a certain caliber. The flare may include a pen flare, a base, and a cylindrical sleeve. The pen flare may include a portion having external threads. The base may include an extractor rim and a through-bore with internal threads. The pen flare may be fixed in the through-bore of the base via the external and internal threads. The cylindrical sleeve may be disposed around a front portion of the base and around the pen flare.

A further aspect of the invention may include a kit for converting a conventional shotgun to a compact shotgun. The kit may include a conversion barrel having a shorter length than a barrel of the conventional shotgun; a conversion magazine spring having a shorter length than a magazine spring of the conventional shotgun; a conversion magazine tube having a shorter length than a magazine tube of the conventional shotgun; and a conversion pump action slide.

The conversion pump action slide may include actions bars, a tube, and a grip. The tube and the grip may each have a shorter length than the tube and the grip of the pump action slide of the conventional shotgun. The kit may also include a pistol grip.

Another method of the invention may include providing a conventional, full-length pump action shotgun and converting it to a compact pump action shotgun. The method may include, after converting the shotgun, reverting the compact shotgun to the conventional-full length pump action shotgun.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Figure 1:
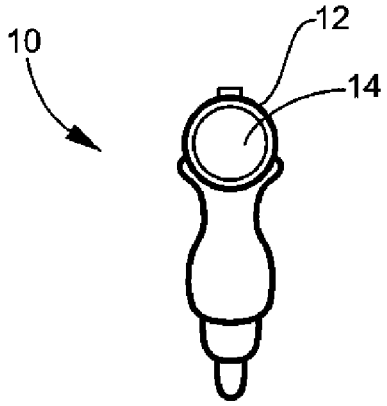
FIG. 1 PRIOR ART
FIG. 1 is an end view from the muzzle of a conventional shotgun.

FIG. 1 is an end view from the muzzle of a conventional pump-action shotgun 10. Shotgun 10 may include a barrel 12 with a bore 14. The size of bore 14 may be referred to as the "gauge" of the shotgun 10, for example, 10 gauge, 12 gauge, 16 gauge, 20 gauge, etc.

Figure 2:
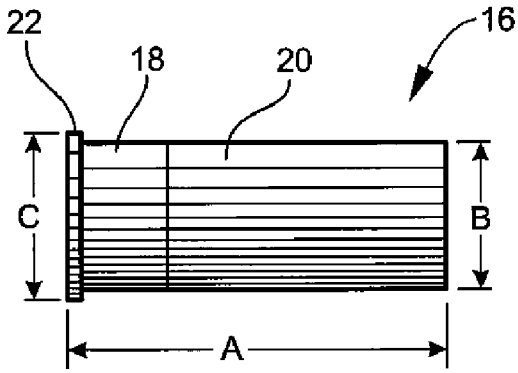
FIG. 2 PRIOR ART
FIG. 2 is a side view of a conventional shotgun cartridge.

FIG. 2 is a side view of a conventional shotgun cartridge 16 that may be fired from shotgun 10. Cartridge 16 may include a base 18 having an extractor rim 22, and a sleeve 20. Extractor rim 22 may have an outside diameter of C. Sleeve 20 may have an outside diameter of B. An overall length of cartridge 16 may be A.

Figure 3:
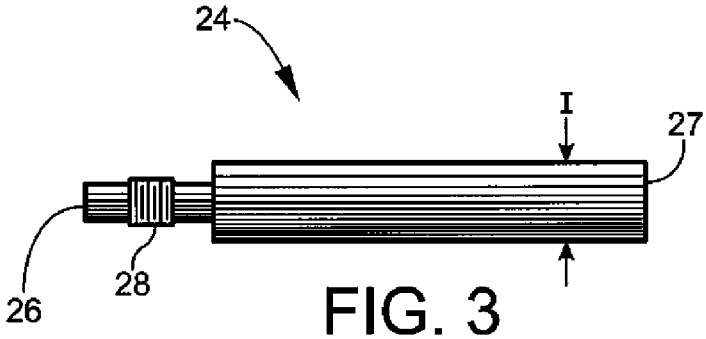
FIG. 3 PRIOR ART
FIG. 3 is a side view of a conventional pen flare.

FIG. 3 is a side view of a conventional pen flare 24. Pen flare 24 may include a portion having external threads 28. One end of pen flare 24 may include a primer 26.

Figure 6:
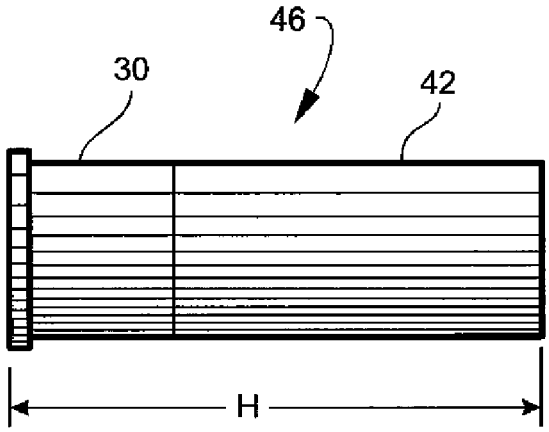
FIG. 6 is a side view of an embodiment of a flare for firing from a conventional shotgun.

FIG. 6 is a side view of a flare 46 suitable for firing from a conventional shotgun 10. Flare 46 may include a base 30 and a sleeve 42.

Figure 4B:
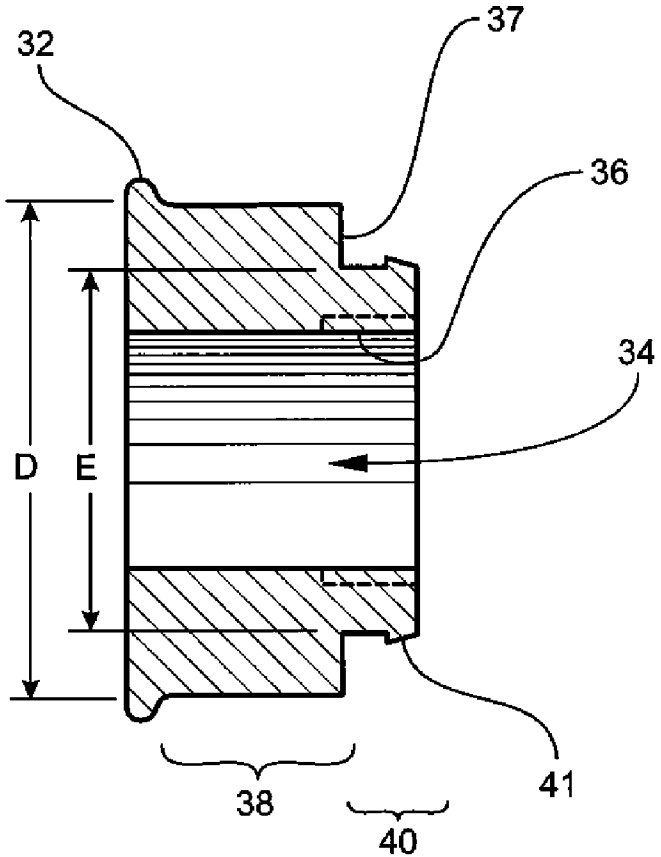
FIG. 4A is a side view and FIG. 4B is a side sectional view of an embodiment of a base for a flare for firing from a conventional shotgun.
Figure 4A:
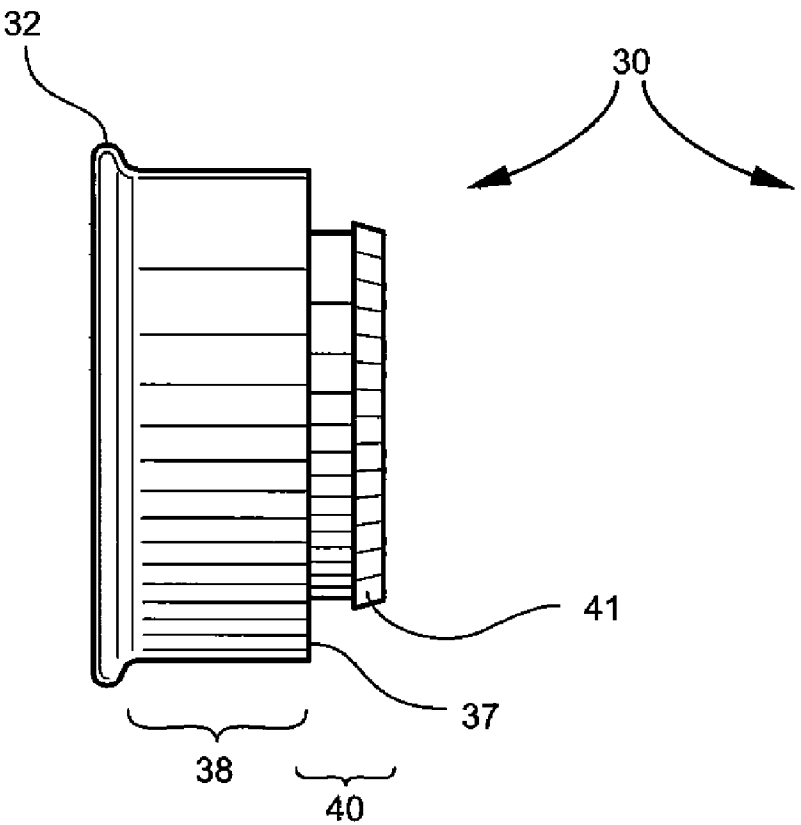

FIG. 4A is a side view of base 30 of flare 46. FIG. 4B is a sectional side view of base 30 of flare 46. Base 30 may include an extractor rim 32, and a through-bore 34 with internal threads 36. Pen flare 24 (FIG. 3) may be fixed in through-bore 34 of base 30 via external threads 28 and internal threads 36. A rear portion 38 of base 30 may be located forward of extractor rim 32. Rear portion 38 may have an outer diameter D that is greater than an outer diameter E of a front portion 40 of base 30.

Figure 5:
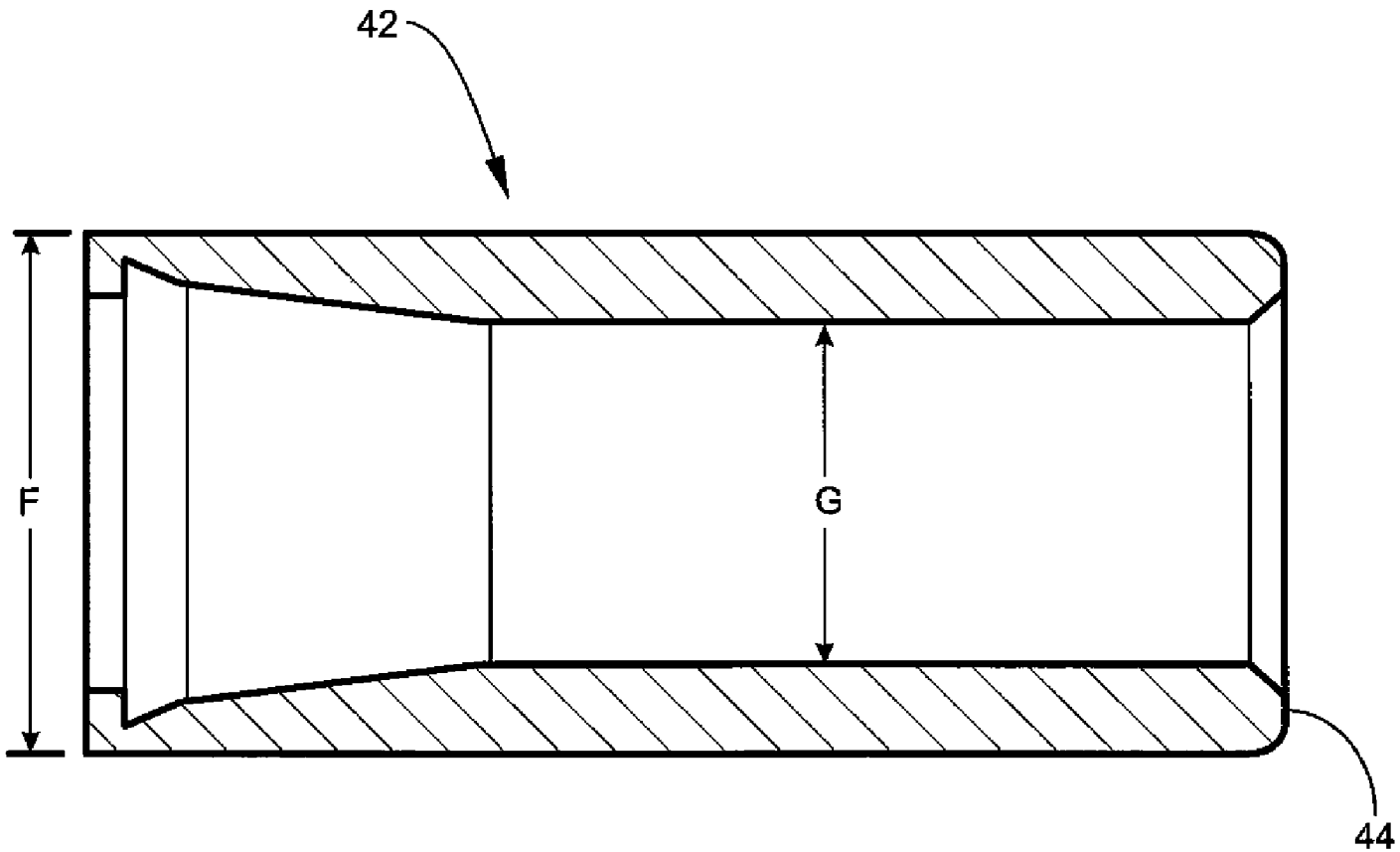
FIG. 5 is a side sectional view of an embodiment of a sleeve for a flare for firing from a conventional shotgun.

FIG. 5 is a side sectional view of an embodiment of a cylindrical sleeve 42 for flare 46. Sleeve 42 may be disposed around front portion 40 of base 30 and around pen flare 24. Sleeve 42 may cover the complete length of pen flare 24 that extends forward beyond the front end 37 of rear portion 38 of base 30.

A projecting portion 41 (FIGS. 4A and B) may be disposed on the outer circumference of front portion 40. Projecting portion 41 may help secure sleeve 42 on front portion 40 of base 30. The inside diameter G of sleeve 42 may be about the same as the outside diameter I (FIG. 3) of pen flare 24. Projecting portion 41 may have a larger outside diameter than the inside diameter G of sleeve 42.

The external dimensions of flare 46 may be substantially the same as the external dimensions of conventional shotgun cartridge 16. External dimensions of flare 46 may be varied so that flare 46 may be suitable for firing from various gauge shotguns, for example, 10 gauge, 12 gauge, 16 gauge, 20 gauge, etc. An overall length H (FIG. 6) of flare 46 may be about the same as overall length A (FIG. 2) of cartridge 16. Extractor rims 22, 32 of cartridge 16 and flare 46, respectively, may have substantially the same outside diameters. Outside diameter B of cartridge 16 may be substantially the same as outside diameter D of flare 46.

Pen flare 24 may be positioned in flare 46 so that the firing mechanism of shotgun 10 may actuate primer 26 of pen flare 24. Because flare 46 may have substantially the same external dimensions as cartridge 16, shotgun 10 may be able to feed, chamber, extract and eject flare 46 in the same manner as cartridge 16.

A plurality of flares 46 may be used in shotgun 10 to fire multiple rounds of warning ammunition during escalation of force. An advantage of conventional shotgun 10 is that the user is already familiar with its operation. Furthermore, shotgun 10 allows multiple shots to be fired rapidly and safely. In addition, shotgun 10 may have a manual safety. Flares 46, in conjunction with conventional shotgun 10, may be a much needed tool for a soldier manning a checkpoint or a soldier in a vehicle turret. Those soldiers may need to fire multiple non-lethal warnings to approaching vehicles or individuals.

Flares 46 and conventional shotgun 10 provide a soldier with the capability of rapidly delivering multiple non-lethal warning shots from a shotgun 10 with a mechanical safety during EOF scenarios. Flares 46 may be loaded into and unloaded from shotgun 10 multiple times.

A kit for adapting pen flare 24 for firing from shotgun 10 may include base 30 and sleeve 42. Base 30 and sleeve 42 may be reused multiple times, for example, as many as eight times. After flare 46 is fired and ejected from shotgun 10, sleeve 42 may be removed from base 30. The spent pen flare 24 may be removed from base 30 and a fresh pen flare 24 inserted in base 30. Sleeve 42 may then be reattached to base 30 to create a fresh flare 46.

Flare 46 and a kit or adapter that may include base 30 and sleeve 42 have been described in connection with shotgun 10. However, the method and apparatus of the invention may be used with or for a weapon of any caliber, whether a shotgun, rifle, or handgun. In all cases, the caliber of the weapon may be larger than the caliber of pen flare 24.

Figure 7:
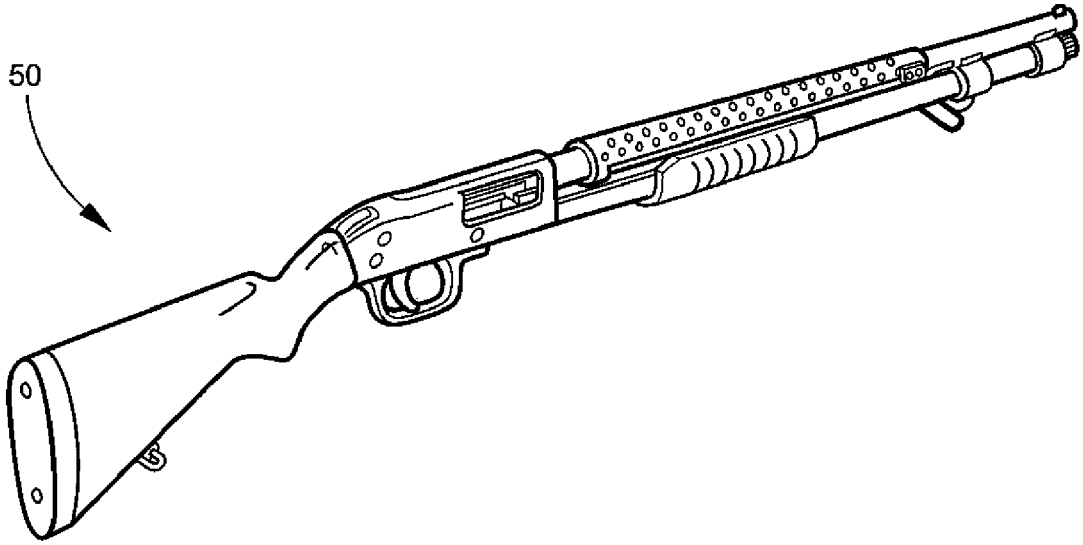
FIG. 7 PRIOR ART
FIG. 7 is a perspective view of a conventional, full-length, pump action shotgun.
Figure 9:
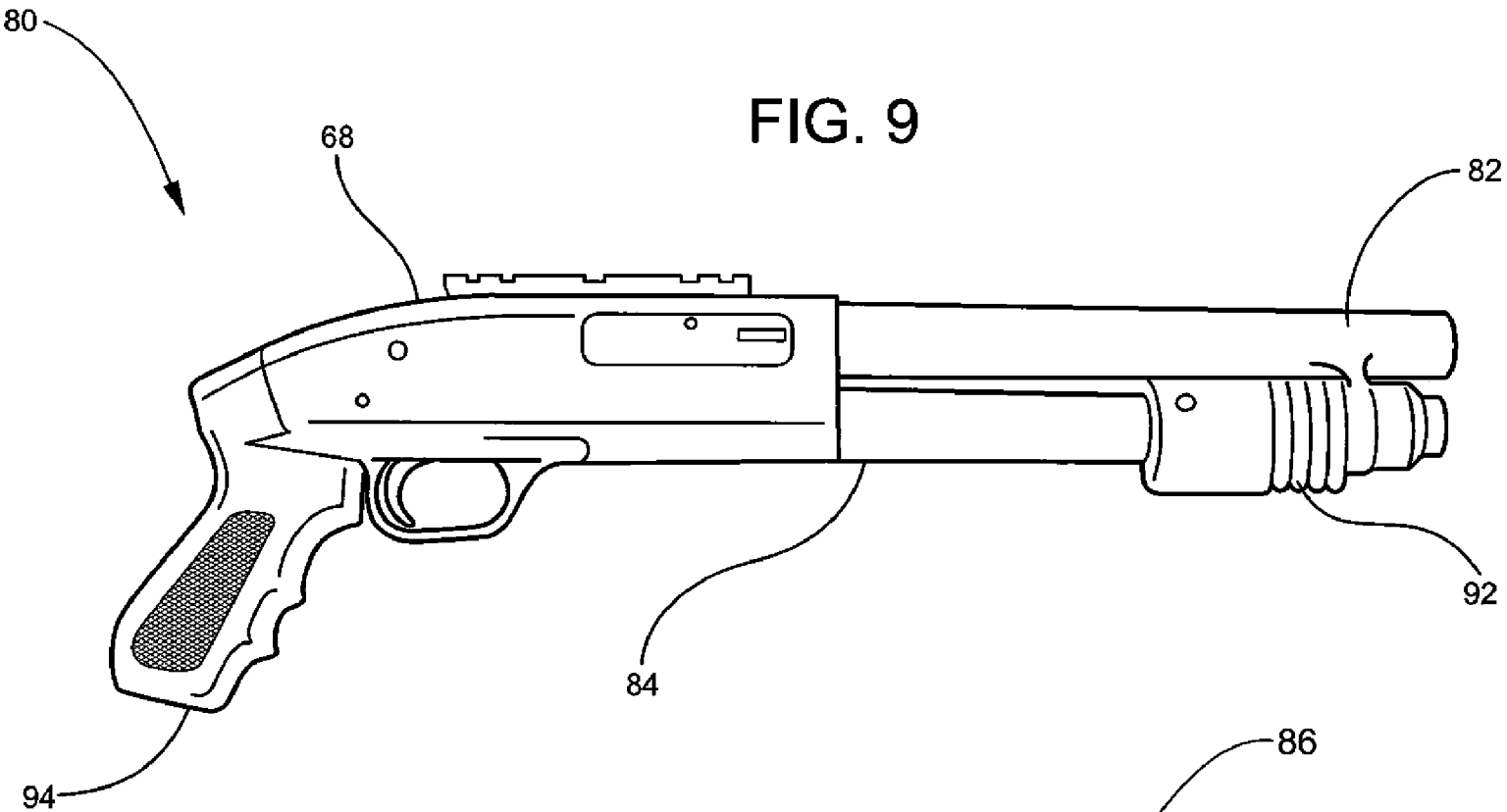
FIG. 9 is a perspective view of a converted, compact shotgun that uses the receiver of the shotgun of FIG. 7.

To realize the advantages of a small, lightweight, compact weapon for firing multiple rounds of "warning" ammunition and/or flares, conventional shotgun 50 (FIG. 7) may be converted to a smaller, lighter, more compact shotgun 80 (FIG. 9). The overall size and weight of converted shotgun 80 may be much less than conventional, full size shotgun 50. The smaller and lighter weight converted shotgun 80 may be a useful tool for a soldier manning a checkpoint or a soldier in a vehicle turret who needs to fire multiple non-lethal warnings to approaching vehicles.

It may be possible to utilize converted, compact shotgun 80 in other roles, such as firing door-breaching ammunition or lethal ammunition. The compactness and ease of maneuverability of converted shotgun 80 may lend itself to a door-breaching tool or an accessory shotgun to mount under a host rifle.

A conversion kit may contain the parts needed to convert shotgun 50 into shotgun 80. As an example, conventional, full-length, pump action shotgun 50 may be a standard issue 12 gauge shotgun, such as a Mossberg model M500 or M590. Shotgun 50 may be converted into compact 4-shot hand held device 80. Shotgun 50 may not be permanently changed. Shotgun 50 may be reverted to its pre-conversion configuration. A minimum of tools, for example, a punch and an Allen wrench may be needed to revert converted shotgun 80 to its pre-conversion configuration. The reversion process may include reinstalling the original, conventional parts.

Figure 8:
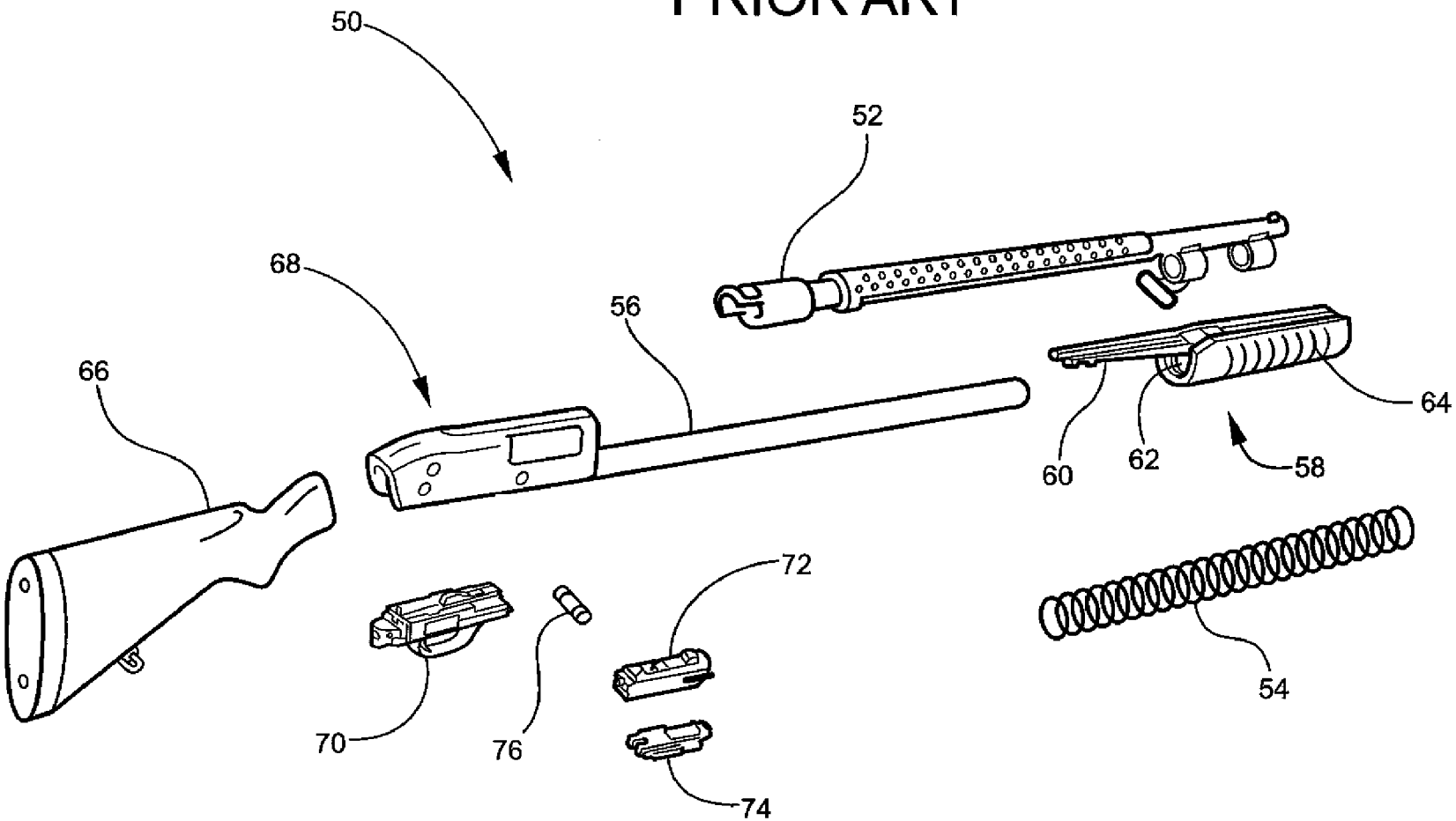
FIG. 8 PRIOR ART
FIG. 8 is an exploded view of the shotgun of FIG. 7.

FIG. 8 is an exploded view of shotgun 50. Shotgun 50 may include a barrel 52, a magazine spring 54, a magazine tube 56, a pump action slide 58, a conventional shoulder stock 66, and a receiver 68. Pump action slide 58 may include action bars 60, tube 62, and a grip 64. Receiver 68 may include a trigger housing assembly 70, a bolt assembly 72, a bolt slide 74, and a trigger pin 76.

Figure 10:
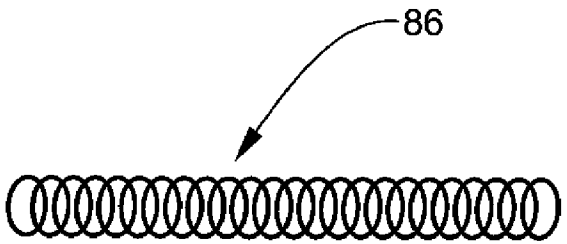
FIG. 10 is a perspective view of a magazine spring for the shotgun of FIG. 9.

FIG. 9 is a perspective view of converted, compact shotgun 80. Shotgun 80 may include the receiver 68 of shotgun 50. Barrel 82 of shotgun 80 may be shorter than barrel 52 of shotgun 50. Magazine tube 84 of shotgun 80 may be shorter than magazine tube 56 of shotgun 50. Magazine tube 84 may hold, for example, three rounds of ammunition, such as 12 gauge ammunition. Magazine spring 86 (FIG. 10) of shotgun 80 may be shorter than magazine spring 54 of shotgun 50. Magazine spring 86 may function reliably with the shortened magazine tube 84 and the reduced amount of ammunition held in magazine tube 84.

Figure 11:
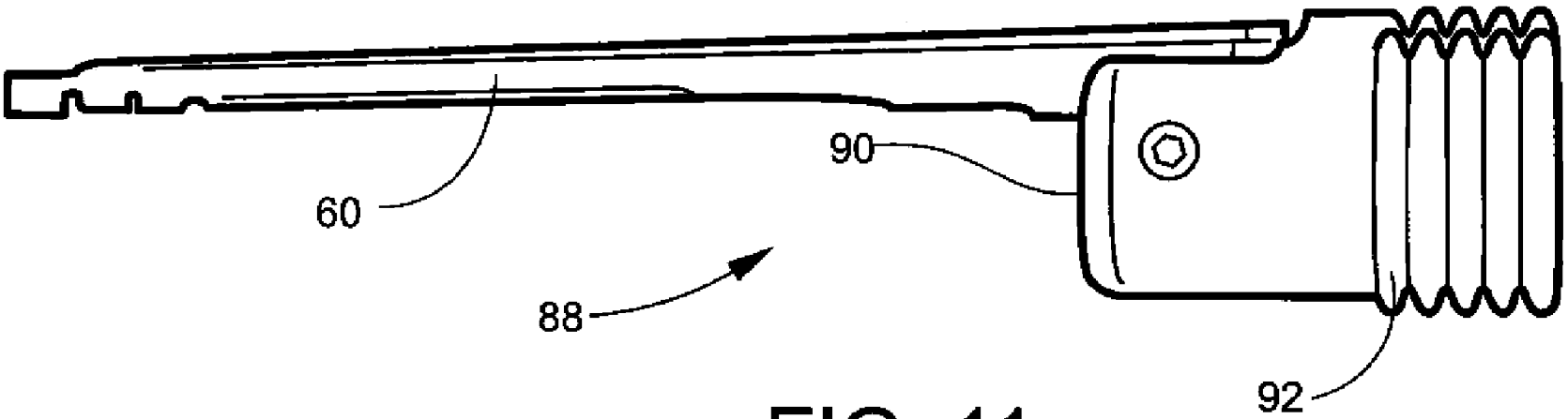
FIG. 11 is a perspective view of a pump action slide for the shotgun of FIG. 9.

Pump action slide 88 (FIG. 11) of shotgun 80 may include action bars 60 like those of shotgun 50. Action tube 90 and action grip 92 of shotgun 80 may be shorter than action tube 62 and action grip 64 of shotgun 50. The shoulder stock 66 (FIG. 8) of shotgun 50 may be replaced with a pistol grip 94 (FIG. 9). The shorter length of shotgun 80 may reduce its size and weight, compared to shotgun 50. Thus, shotgun 80 may be more compact and easily handled.

A kit may include barrel 82, magazine tube 84, magazine spring 86, pump action slide 88, and pistol grip 94. The kit may be used to convert shotgun 50 into shotgun 80. Once converted, the parts removed from shotgun 50 may be retained for future use. That is, shotgun 80 may be reverted to shotgun 50 by removing barrel 82, magazine tube 84, magazine spring 86, pump action slide 88, and pistol grip 94, and then, installing barrel 52, magazine spring 54, magazine tube 56, pump action slide 58, and shoulder stock 66. The kit may avoid the need to purchase two complete weapons. It may be easier to purchase, stock, and supply components rather than complete weapons.

Users of the kit may be, for example, military organizations, law enforcement organizations or other organizations. The organizations may already have shotguns 50 in inventory. For example, a military unit may be deployed with shotguns

50. The military unit may find themselves in a situation where, temporarily, shorter shotguns 80 may be beneficial. Then, when there is no longer a need for shorter shotguns 80, shotgun 80*s* may be reverted to shotguns 50.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A method comprising: adapting a pen flare for firing from a weapon having a caliber larger than a caliber of the pen flare, wherein the pen flare includes external threads and adapting includes providing a base having a through-bore with internal threads and threading the pen flare into the base.

2. The method of claim 1, wherein the pen flare includes external threads and adapting includes providing a base having a through-bore with internal threads and threading the pen flare into the base.

3. The method of claim 2, wherein adapting includes placing a cylindrical sleeve over the pen flare and connecting the cylindrical sleeve to the base.

4. A kit for adapting a pen flare having external threads for firing from a weapon having a caliber, comprising:

a base including an extractor rim and a through-bore with internal threads for mating with the external threads of the pen flare;

a rear portion of the base, located forward of the extractor rim, having an outer diameter that is greater than an outer diameter of a front portion of the base; and a cylindrical sleeve for disposing around the front portion of the base and around the pen flare.

5. The kit of claim 4, further comprising the pen flare.

6. The kit of claim 4, wherein external dimensions of an assembly comprising the base and the cylindrical sleeve are substantially same dimensions as external dimensions of a conventional cartridge of the caliber of the weapon.

7. The kit of claim 6, wherein the weapon is a shotgun.

8. The kit of claim 6, wherein the front portion of the base includes a projecting portion on its outer circumference.

9. A flare for firing from a weapon having a caliber, comprising:

a pen flare with a portion having external threads;

a base including an extractor rim and a through-bore with internal threads, the pen flare being fixed in the through-bore of the base via the external and internal threads;

a rear portion of the base, located forward of the extractor rim, having an outer diameter that is greater than an outer diameter of a front portion of the base; and a cylindrical sleeve disposed around the front portion of the base and around the pen flare.

10. The flare of claim 9, wherein external dimensions of the flare are substantially same dimensions as external dimensions of a conventional cartridge of the caliber of the weapon.

11. The flare of claim 10, wherein the weapon is a shotgun.

12. The flare of claim 10, wherein the front portion of the base includes a projecting portion on its outer circumference.

13. The flare of claim 12, wherein the cylindrical sleeve covers a complete length of the pen flare that extends forward beyond a front end of the front portion of the base.

* * * * *